US011825881B2

(12) United States Patent
Fursa et al.

(10) Patent No.: US 11,825,881 B2
(45) Date of Patent: Nov. 28, 2023

(54) AEROSOL-GENERATING DEVICE PROVIDING SECURE RETENTION FOR AEROSOL-GENERATING ARTICLES

(71) Applicant: PHILIP MORRIS PRODUCTS S.A., Neuchatel (CH)

(72) Inventors: Oleg Fursa, Neuchatel (CH); Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1256 days.

(21) Appl. No.: 16/330,924

(22) PCT Filed: Sep. 14, 2017

(86) PCT No.: PCT/EP2017/073110
§ 371 (c)(1),
(2) Date: Mar. 6, 2019

(87) PCT Pub. No.: WO2018/050735
PCT Pub. Date: Mar. 22, 2018

(65) Prior Publication Data

US 2019/0230989 A1 Aug. 1, 2019

(30) Foreign Application Priority Data

Sep. 15, 2016 (EP) ..... 16188924

(51) Int. Cl.
*A24F 40/485* (2020.01)
*A24F 40/20* (2020.01)
*A24D 1/20* (2020.01)

(52) U.S. Cl.
CPC ..... *A24F 40/485* (2020.01); *A24D 1/20* (2020.01); *A24F 40/20* (2020.01)

(58) Field of Classification Search
CPC ..... A24F 40/20; A24F 40/40; A24F 40/485
See application file for complete search history.

(56) References Cited

U.S. PATENT DOCUMENTS 9,532,603 B2 1/2017 Plojoux
9,532,605 B2 1/2017 Yamada
(Continued)

FOREIGN PATENT DOCUMENTS

CN 203563687 4/2014
CN 203563687 U * 4/2014
(Continued)

OTHER PUBLICATIONS

Office Action issued in Korea for Application No. 10-2019-7009966 dated Nov. 2, 2022 (12 pages). English translation included.
(Continued)

*Primary Examiner* — Hae Moon Hyeon
(74) *Attorney, Agent, or Firm* — Mueting Raasch Group

(57) ABSTRACT

The aerosol-generating device (200) comprises a device housing comprising a cavity having an internal surface forming part of a receiving chamber (230) for receiving at least a portion of an aerosol-generating article (10). A plurality of ribs (2301) extends into the cavity and are arranged along an internal sidewall of the receiving chamber and in an oblique manner relative to a longitudinal axis (2300) of the receiving chamber. The retention ribs are configured for contacting at least a portion of the aerosol-generating article.

13 Claims, 2 Drawing Sheets

(56) References Cited

U.S. PATENT DOCUMENTS

| | | | | |
|---|---|---|---|---|
| 2005/0045193 | A1 | 3/2005 | Yang | |
| 2005/0154765 | A1 | 7/2005 | Seitz | |
| 2014/0338686 | A1 | 11/2014 | Plojoux | |
| 2020/0154765 | A1 | 5/2020 | Lee | |
| 2022/0408811 | A1* | 12/2022 | Batista | A24F 40/40 |

FOREIGN PATENT DOCUMENTS

| | | | | |
|---|---|---|---|---|
| EP | 0503767 | | 5/1995 | |
| EP | 2782463 | | 10/2014 | |
| EP | 2443946 | | 11/2014 | |
| EP | 2994000 | | 3/2016 | |
| EP | 2810570 | | 10/2018 | |
| JP | H03-108472 | | 5/1991 | |
| JP | H05-115372 | | 5/1993 | |
| JP | 2015-504667 | | 2/2015 | |
| JP | 2020-516268 | | 6/2020 | |
| KR | 10-2014-0123487 | | 10/2014 | |
| WO | WO 2013/076098 | | 5/2013 | |
| WO | WO 2013/098395 | | 7/2013 | |
| WO | WO 2015/071703 | | 5/2015 | |
| WO | WO-2015082649 | A1 * | 6/2015 | A24B 15/167 |
| WO | WO 2015/117702 | | 8/2015 | |
| WO | WO 2015/177253 | | 11/2015 | |

OTHER PUBLICATIONS

Office Action issued in Japan for Application No. 2019-514724 dated Oct. 4, 2021 (9 pages). English translation included.

International Preliminary Report on Patentability for PCT/EP2017/073110 dated Dec. 14, 2018 (16 pages).

Office Action issued in Japan for Application No. P 2019-514724 dated Oct. 4, 2021 (9 pages). English translation included.

PCT Search Report and Written Opinion for PCT/EP2017/073110 dated Nov. 24, 2017 (13 pages).

* cited by examiner

AEROSOL-GENERATING DEVICE PROVIDING SECURE RETENTION FOR AEROSOL-GENERATING ARTICLES

This application is a U.S. National Stage Application of International Application No. PCT/EP2017/073110 filed Sep. 14, 2017, which was published in English on Mar. 22, 2018, as International Publication No. WO 2018/050735 A1. International Application No. PCT/EP2017/073110 claims priority to European Application No. 16188924.1 filed Sep. 15, 2016.

TECHNICAL FIELD

The invention relates to an aerosol-generating device, in particular to an aerosol-generating device comprising improved retention for an aerosol-generating article accommodated in the device.

BACKGROUND

In electrical smoking devices a receiving chamber to receive an aerosol-generating article provides a tight fit for the article to hold the article in the chamber. In devices comprising an integral heater blade the latter may additionally support a retention of the article due to compression of tobacco substrate in the article by the heater blade. However, in systems using inductive heating, an inductively heatable susceptor material is typically integral with the article not providing additional support. In addition in a tight fit of the article in a receiving chamber the chamber walls may provide a heat sink, for example, causing formation of parasitic condensate. Yet further, a resistance to draw (RTD) may be high making a smoking difficult. On the other hand, in the process of smoking a tobacco plug tends to shrink thus reducing a retention between the plug and a surrounding chamber wall thereby altering the risk of the article to be displaced or to fall out of the device.

Thus, there is need for aerosol-generating devices having improved retention for aerosol-generating articles inserted into the devices. In particular there is need for aerosol-generating devices having improved retention for inductively heatable aerosol-generating articles.

SUMMARY

According to the invention there is provided an aerosol-generating device comprising a device housing comprising a cavity having an internal surface forming part of a receiving chamber for receiving at least a portion of an aerosol-generating article. A plurality of retention ribs extending into the cavity are arranged along an internal sidewall of the receiving chamber in an oblique manner relative to a longitudinal axis of the receiving chamber. The retention ribs are configured for contacting at least a portion of the aerosol-generating article when said article is accommodated in the cavity of the device housing. The longitudinal axis typically corresponds to an insertion and removal direction of an article into the cavity and from the cavity. Preferably, the plurality of retention ribs is arranged along helicoidal lines.

DETAILED DESCRIPTION

While it is known to provide a circumferentially running protrusion at an inlet opening of a cavity of a device to support retention of an article in the cavity such a protrusion forms a barrier for aerosol or air to pass along the outside of the article inserted into the cavity. With ribs arranged in an oblique manner or along one or several helicoidal lines an airflow may pass along the cavity. In addition, the oblique ribs offer additional resistance to the removal of the article, compared to, for example, straight ribs.

For example, a user handling a device having a receiving chamber provided with ribs arranged in an oblique manner, may extract the article by applying an axial force together with a torque in order to facilitate removal. Such a rotational movement, even if only slightly expressed, does not occur during a smoking experience. Hence an accidental extraction of the article may be prevented by using a receiving chamber of a device according to the invention.

In addition, during smoking, an aerosol-forming substrate, for example a tobacco end of an article, produces condensates, which moisten the surrounding wrapping paper thereby weakening it. With a high retention pressure applied essentially on an entire surface of the tobacco end of the aerosol-generating article, this may enhance the risk of breaking the article during extraction thereof. By reducing the retention pressure and by reducing the overall contact surface between tobacco end and chamber walls the risk of breaking the article may be reduced.

Yet a further advantage of the provision of retention ribs in a receiving chamber is that a direct contact between article and chamber walls is reduced. This is particularly advantageous where heat for heating an aerosol-forming substrate in the article occurs in the article itself. With reduced contact of chamber walls also contact with 'cold' chamber wall surfaces is reduced. Thus, heat loss through chamber walls is reduced and the risk of condensate formation on the chamber walls is also reduced. The one effect is to be avoided in view of energy efficiency and overall performance of the device. This other effect of condensate formation may negatively influence a smoking experience and may cause extensive cleaning of the device. This may be a challenge when accessibility to parts to be cleaned is limited.

The term 'oblique' with respect to a longitudinal axis of the cavity is understood such that the ribs do not extend ring-like around the inner circumference of a cavity and do not extend exactly longitudinally along the inner surface of the cavity. The ribs are turning around the longitudinal axis of the cavity and have a pitch which is larger than 0 mm (corresponding to ring-like arranged ribs).

The pitch is defined as being a (virtual) length in the direction of the longitudinal axis over which the rib performs one full turn of 360 degree. At pitch values smaller than a length of the receiving chamber, a rib performs more than one turn in the receiving chamber. At pitch values larger than a length of the receiving chamber a rib performs less than an entire turn in the receiving chamber.

Preferably, a rib turns with a pitch between 100 mm and 250 mm, more preferably between 120 mm and 200 mm, for example 150 mm.

The retention ribs are arranged along a line or lines along a length of the inner surface of the cavity, which lines are oblique with respect to a longitudinal axis of the cavity in a receiving chamber.

Ribs turning with large pitch values provide the advantage of providing resistance in the direction of the longitudinal axis, that is, into a removing direction of an article out of the cavity. At the same time ribs turning with large pitch values do not provide too much resistance upon insertion and removal of the article. Ribs turning with large pitch values additionally allow a passing of an airflow or an aerosol containing airflow along the cavity and along the receiving chamber without many or abrupt directional changes. Preferably, a plurality of ribs turning with large pitch values is arranged along the internal sidewall of the receiving chamber. However, also one continuous or discontinuous rib turning with a smaller pitch value may be arranged in a spiraling manner along the internal sidewall of the receiving chamber.

In tubular-shaped cavities, for example, having a circular or oval cross-section, the ribs are arranged in an oblique manner and are also curved.

Preferably, the retention ribs of the plurality of ribs are distanced from each other, thereby defining airflow passages in between neighbouring retention ribs.

Advantageously, the airflow passages are dimensioned such that during use of the device a resistance to draw (RTD) of between 70 mmWG and 120 mmWG is achieved.

Shape and arrangement of the retention ribs are selected and adapted to provide a certain RTD of the device when in use.

A rib or ribs may be continuous or may be discontinuous. For example, a series of discontinuous ribs may be arranged along a same oblique, helicoidal line. Advantageously, ribs are arranged on parallel oblique lines, preferably on parallel helicoidal lines. Thereby, the ribs itself may be arranged next to each other or may be displaced with respect to the direction of the oblique or helicoidal line.

Preferably, each of the retention ribs are continuous, preferably extending along an entire length of the internal sidewall of the receiving chamber.

Preferably, a plurality of ribs is arranged along the internal sidewall of the receiving chamber and along a plurality of helicoidal lines. Preferably more than two ribs, more preferably more than five ribs are arranged along the internal sidewall of the receiving chamber along a plurality of helicoidal lines.

Preferably, the oblique or helicoidal lines are arranged in parallel, preferably along an entire internal sidewall of the receiving chamber. The internal sidewall may be in the form of a corrugated wall. Therein, a longitudinal axis of the corrugations is oblique with respect to the longitudinal axis of the cavity in the receiving chamber. A corrugated internal sidewall of the receiving chamber has the advantageous effect of regularly and basically symmetrically reducing the contact surface with an aerosol-generating article when compared to a smooth wall, where the contact surface is maximum. By this, a conductive heat exchange between the article or at least an aerosol-forming substrate portion of the article and the surrounding wall is reduced and hence condensation and temperature gradient within the article or substrate are reduced. This may establish a more homogenous temperature distribution in a heated portion of the article allowing a more efficient use of aerosol-forming substrate, for example tobacco, for aerosol generation. This effect may particularly be advantageous in peripheral areas of the article.

A cavity for receiving an aerosol-generating article comprises an inlet opening corresponding to an inlet of a receiving chamber. Preferably, the cavity has a shape adapted to the shape of an aerosol-generating article. Preferably, a circumference of the inner surface of the cavity is of cylindrical shape and the receiving chamber has a cylindrical shape. Preferably, the circumference of the inner surface of the cavity is of circular but may also be of, for example, oval shape.

The special arrangement of ribs in a receiving chamber of an aerosol-generating device provides a proper retention of the aerosol-forming article as well as channels to ensure air flow passage, wherein the channels are formed between neighbouring ribs and possibly also between discontinuous ribs.

A retention rib of the plurality of ribs may have a variable height along its development on the internal sidewall of the receiving chamber. Preferably, at least one rib has a variable height along its development on the internal sidewall of the receiving chamber. Preferably each rib of the one or more ribs or of the plurality of ribs has a variable height along its development on the internal sidewall of the receiving chamber.

Preferably, a most protruding portion of the rib or ribs is arranged at a portion of the chamber where, in operation, a strong or flexible element of the aerosol-generating article is positioned in the receiving chamber of the device. Such a portion may be arranged between a distal portion of the chamber and an inlet portion of the chamber.

Aerosol-generating articles for electronic smoking devices often imitate the form of conventional cigarettes and are made of an assembly of several different elements. These elements may have very different physical properties, in particular with respect to flexibility. Some elements, such as, for example, tobacco elements, are soft and deformable, while, for example, support elements and aerosol-cooling elements may provide some flexibility. Thus, a most protruding portion of a rib or ribs may, for example, be arranged at a portion of the chamber where, in operation, a support element of the aerosol-generating article is accommodated. By this, the highest retention is advantageously exerted on the support element which has a physical structure apt to bear such pressure.

The height of the rib or ribs may decrease in the direction of a distal portion of the receiving chamber such that the height of the rib or ribs is smaller in a distal portion of the receiving chamber than in a more downstream portion. In a distal portion of the chamber, during smoking, an aerosol-forming substrate, for example a tobacco substrate, is located. Be reducing the height of the rib or ribs in the distal portion, a retention action is lessened onto the tobacco substrate and any risk of breaking due to a weakened wrapping paper soaked by condensate may be reduced. At the same time channels for airflow are still provided.

'Distal' is herein understood as a position opposite a mouth end or a proximal end of the device. A 'distal' portion of the receiving chamber is understood as a most upstream portion of the receiving chamber or a portion of the receiving chamber opposite an inlet of the receiving chamber. 'Distal' and 'proximal' are used herein to describe the positions of elements in the device or in the article.

'Upstream' and 'downstream' are used herein to describe the relative positions of elements referring to the direction of an airflow passing through the device or the article. Downstream end and upstream end or proximal end and distal end are used to describe the position in the device or the orientation of the article in a direction in which a user draws on the article. In the aerosol-generating article comprising an aerosol-forming substrate and a mouthpiece, the mouthpiece corresponds to a downstream end of the article and the aerosol-forming substrate corresponds to an upstream end of the article. Accordingly, a user draws on the downstream end of the aerosol-generating article so that air enters the upstream end of the aerosol-generating article and moves downstream to the downstream end. In the aerosol-generating device comprising a receiving chamber for accommodating an aerosol-generating article, the mouth end or inlet portion of the receiving chamber corresponds to a downstream end of the device.

The internal sidewall may comprise a distal portion, a proximal portion adjacent to the distal portion and an inlet portion adjacent to the proximal portion. The inlet portion is arranged at a proximal end of the aerosol-generating device. Preferably, the plurality of retention ribs is arranged in the distal portion, in the proximal portion and in the inlet portion of the internal sidewall of the receiving chamber. Thus, preferably, the ribs are arranged to extend on or over an entire length of an internal sidewall of a receiving chamber. This bears the advantage that retention may be provided on the entire portion of an article that is accommodated in the receiving chamber. In addition, a contact surface between article and chamber wall may be reduced also on the entire portion of the article, which portion is accommodated in the receiving chamber. Yet further it is possible to additionally adapt a retention pressure on the article in different regions of the receiving chamber, for example, by varying a number, form, distribution or height of ribs in different portions of the internal chamber wall of the receiving chamber. Preferably, the height of the ribs is chosen differently in the different portions of the internal sidewall of the receiving chamber.

For example, each of the retention ribs may have a first height in the distal portion of the internal sidewall and may have a second height in the proximal portion of the internal sidewall, wherein the second height is larger than the first height. Since an aerosol-forming substrate is positioned at a distal end of the receiving chamber, retention pressure is lessened in this region. However, safe retention of the article may be obtained by the firmer grip of the higher rib or ribs of the more downstream arranged proximal portion of the chamber wall.

The retention ribs may have a third height in the inlet portion. Preferably, each of the retention ribs has a third height in the inlet portion. Thereby, the second height is larger than the third height. Preferably, the third height is equal or substantially equal to the first height. A diminished height of ribs in an inlet portion with respect to the height of ribs of an adjacent proximal portion may facilitate the insertion of an article into the receiving chamber.

The height of the ribs defines an effective inner diameter of the cavity in the receiving chamber. Large rib heights diminish the diameter and lead to enhancement of a retention pressure on an article inserted into the cavity.

Preferably, a maximum retaining action of the receiving chamber is provided by the ribs or the portion of the ribs that are located in the proximal portion of the receiving chamber, preferably acting solely on a support element in the aerosol-generating article.

A height of a rib or ribs may be the same over an entire portion or may vary along that portion. For example in an inlet portion a rib height may increase from a downstream to an upstream end of the inlet portion. This may further facilitate an insertion of the article into the cavity.

Distal portion, proximal portion and inlet portion may be equally distributed over the internal sidewall of the receiving chamber, that is, may have identical lengths.

However, preferably, the distal portion covers the largest part of the internal sidewall and the inlet portion covers the smallest part of the internal sidewall of the receiving chamber.

Preferably, the distal portion extends over a length between about 50 percent to about 75 percent of the internal sidewall.

Preferably, the proximal portion extends over a length between about 20 percent to about 30 percent of the internal sidewall.

Preferably, the inlet portion extends over a length between about 3 percent to about 15 percent of the internal sidewall.

Thereby, the sum of the length of inlet portion, proximal portion and distal portion add to 100 percent.

Herein, the term "about" is understood as explicitly including and disclosing the respective boundary values.

The aerosol-generating device may, for example, use resistive or inductive heating of an article for aerosol generation. In inductive heating devices, the device may comprise an inductor being arranged such as to surround the distal portion of the internal sidewall of the receiving chamber. For example, the inductor may be an inductor coil arranged within the sidewall of the receiving chamber. Preferably, the inductor is arranged such as to surround at least the distal portion of the internal sidewall, more preferably, the inductor is arranged such as to surround only the distal portion of the internal sidewall of the receiving chamber.

The device may further comprise a power source, for example a battery, connected to a heating element or an inductor and electronics, configured to allow the heating element to be heated or the inductor to be actuated. The power source may, for example, be configured to provide a high frequency current to the inductor, for example to one or several induction coils.

According to the invention, there is also provided a receiving chamber of an aerosol-generating device for receiving at least a portion of an aerosol-generating article. The receiving chamber comprises a chamber wall enclosing a cavity with a plurality of retention ribs extending into the cavity. The retention ribs are arranged along an internal sidewall of the receiving chamber and in an oblique manner relative to a longitudinal axis of the receiving chamber. Preferably, the retention ribs are arranged along the internal sidewall of the receiving chamber along helicoidal lines.

The receiving chamber may be a separate, for example pre-manufactured, part to be inserted into a device housing of an aerosol-generating device. This may allow to improve retention and airflow management of existing aerosol-generating devices. It may also allow to adapt aerosol-generating devices to be better suited for aerosol-generating articles comprising tobacco plugs, in particular inductively heatable tobacco plugs and improve a resistance to draw.

For inductive heating devices, an inductor, for example an induction coil, may be integrated into the receiving chamber. For example, the inductor may be arranged in the sidewall of the receiving chamber or may be arranged outside the receiving chamber, for example, wound around the receiving chamber. An inductor may also be part of the device housing and may be arranged next to the receiving chamber, preferably next to a distal portion of the receiving chamber. Features and advantages of the receiving chamber have been discussed relating to the aerosol-generating device and will not be repeated.

Advantageously, the internal sidewall of the receiving chamber comprises a distal portion, a proximal portion adjacent to the distal portion and an inlet portion adjacent to the proximal portion. The inlet portion is further arranged at a proximal end of the receiving chamber. Therein, each of the retention ribs has a first height in the distal portion and a second height in the proximal portion, wherein the second height is larger than the first height.

There may also be provided an aerosol generating system comprising an aerosol-generating device comprising a device housing 202 comprising a cavity 204 having an internal surface forming part of a receiving chamber of the device. The system further comprises an aerosol-generating article at least partly accommodated in the cavity. Preferably, the aerosol-generating device is a device according to the invention and as described herein. In the device, a plurality of ribs extending into the cavity of the receiving chamber is arranged along an internal sidewall of the receiving chamber. The plurality of retention ribs may be arranged along an internal sidewall of the receiving chamber in an oblique manner relative to a longitudinal axis of the receiving chamber and contact the at least a portion of the aerosol-generating article accommodated in the cavity.

The plurality of ribs may be distanced from each other and defines an airflow passage in between ribs of the plurality of ribs. The airflow passage has a dimension such that during use of the system, a resistance to draw (RTD) is between 70 mmWG and 120 mmWG.

An aerosol-generating article accommodated in a cavity of a receiving chamber may basically form a substantially (air-tight contact with the internal chamber wall. In the system and device according to the invention, the article forms contact with the ribs in the cavity. The ribs distance the outer circumference of the article from the internal chamber sidewall and the spacing between the ribs provides an airflow passage between the ribs. This airflow passage allows that a resistance to draw of the system is in a desired range providing a comfortable smoking experience to a user.

BRIEF DESCRIPTION OF THE DRAWINGS

The invention is further described with regard to embodiments, which are illustrated by means of the following drawings, wherein:

FIG. 1 illustrates an aerosol-generating article 10. The aerosol-generating article 10 comprises four elements arranged in coaxial alignment: an aerosol-forming substrate 20, a support element 30, an aerosol-cooling element 40, and a mouthpiece 50. Each of these four elements is a substantially cylindrical element, each having substantially the same diameter. These four elements are arranged sequentially and are circumscribed by an outer wrapper 60 to form a cylindrical rod. A blade-shaped susceptor 25 is located within the aerosol-forming substrate, in contact with the aerosol-forming substrate. The susceptor 25 has a length that is approximately the same as the length of the aerosol-forming substrate, and is located along a radially central axis of the aerosol-forming substrate.

Figure 1:
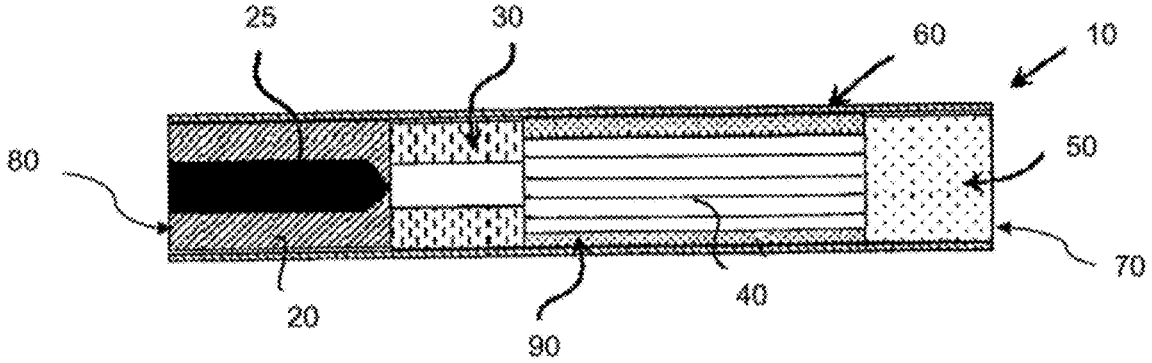
FIG. 1 shows an aerosol-generating article comprising an aerosol-forming substrate.

The aerosol-generating article 10 has a proximal or mouth end 70, which a user inserts into his or her mouth during use, and a distal end 80 located at the opposite end of the aerosol-generating article 10 to the mouth end 70.

The support element 30 is located immediately downstream of the aerosol-forming substrate 20 and abuts the aerosol-forming substrate 20. In the embodiment shown in FIG. 1, the support element 30 is a hollow cellulose acetate tube. The support element 30 locates the aerosol-forming substrate 20 at the extreme distal end 80 of the aerosol-generating article 10 so that it can be penetrated by the susceptor 25 during manufacture of the aerosol-generating article 10. Thus, the support element 30 helps prevent the aerosol-forming substrate 20 from being forced downstream within the aerosol-generating article 10 towards the aerosol-cooling element 40 when the susceptor 25 is inserted into the aerosol-forming substrate 20. The support element 30 also acts as a spacer to space the aerosol-cooling element 40 of the aerosol-generating article 10 from the aerosol-forming substrate 20.

The aerosol-generating article 10 illustrated in FIG. 1 is designed to engage with an electrically-operated aerosol-generating device comprising an induction coil, or inductor, in order to be smoked or consumed by a user.

Figure 2:
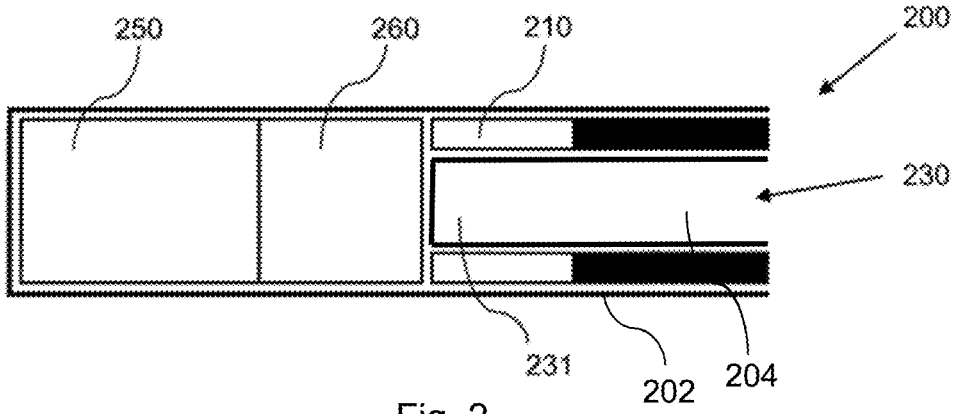
FIG. 2 shows an aerosol-generating device with receiving chamber.

A schematic cross-sectional illustration of an electrically-operated aerosol-generating device 200 is shown in FIG. 2. The device 200 comprises a substrate receiving chamber 230, typically having a cylindrical shape and comprising a cavity for receiving at least a portion of an aerosol-generating article, for example the article as illustrated in FIG. 1.

The aerosol-generating device 200 comprises an inductor 210. As shown in FIG. 2, the inductor 210 is located adjacent a distal portion 231 of the substrate receiving chamber 230 of the aerosol-generating device 200. In use, the user inserts an aerosol-generating article 10 into the cavity of the substrate receiving chamber 230 of the aerosol-generating device 200 such that the aerosol-forming substrate 20 of the aerosol-generating article 10 is located adjacent to the inductor 210.

The aerosol-generating device 200 comprises a battery 250 and electronics 260 that allow the inductor 210 to be actuated. Such actuation may be manually operated or may occur automatically in response to a user drawing on an aerosol-generating article 10 inserted into the substrate receiving chamber 230 of the aerosol-generating device 200.

Figure 3:
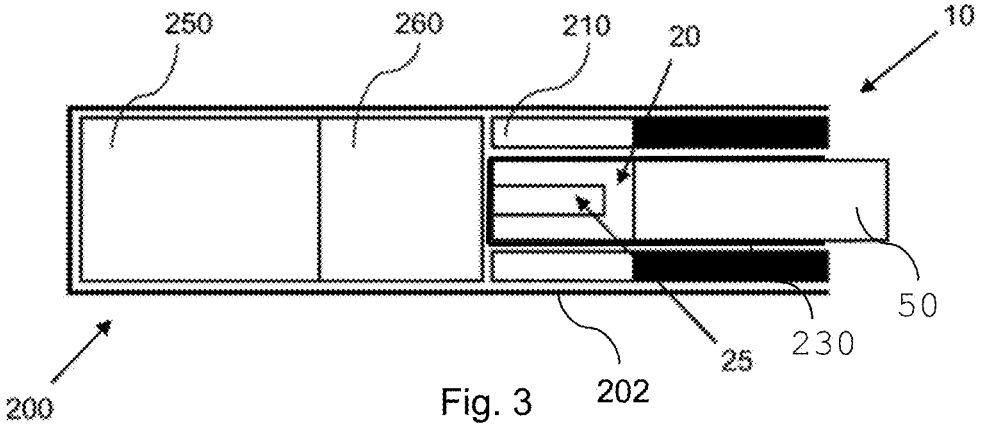
FIG. 3 shows an aerosol-generating device with an inductively heatable aerosol-generating article arranged in the receiving chamber of the device.

FIG. 3 illustrates an aerosol-generating article in engagement with an electrically-operated aerosol-generating device.

The receiving chamber 230 internally defines three adjacent portions defined by its internal sidewall and subsequently positioned along an axial development of the receiving chamber 230. The three portions include a distal portion 231 adapted to accommodate the aerosol-forming substrate 20, a proximal portion 232 adapted to accommodate the support element 30 and an inlet portion 233 which is adapted to accommodate at least a portion of the aerosol-cooling element 40.

It will be appreciated that the mouthpiece 50, as illustrated in FIG. 3, projects out of the aerosol-generating device 200 for the user's puffing. The mouthpiece 50 is firmly kept is position, thus ensuring a comfortable user experience, with a retaining action that the receiving chamber 230 exerts on the portion of aerosol-generating article 10 which is inserted therein, as will explained in more detail below.

Figure 4:
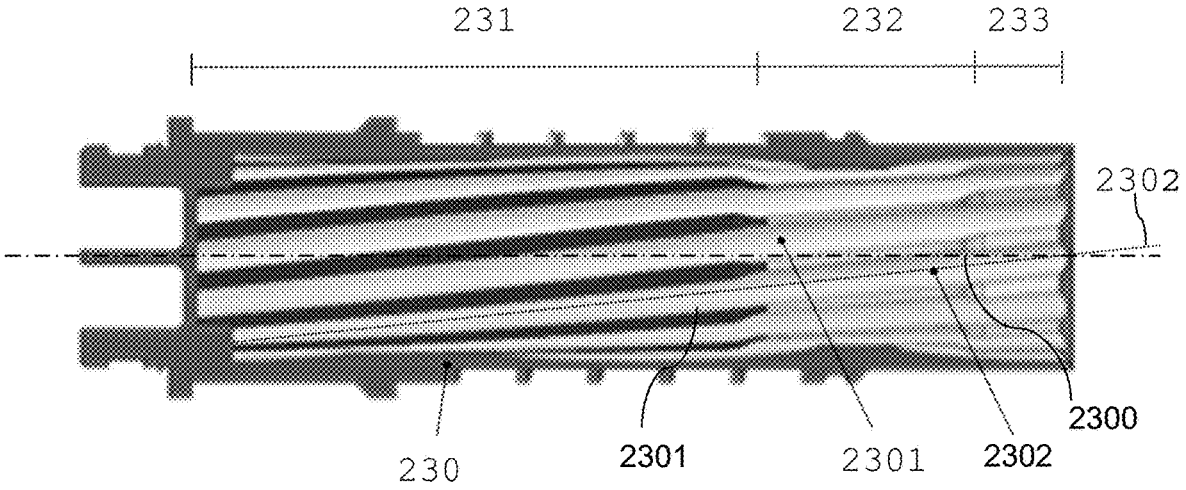
FIG. 4 is a cross-sectional view of a receiving chamber with internal structures.

The receiving chamber 230 comprises on its internal sidewall equidistantly arranged retention ribs 2301, as shown in FIG. 4. The ribs extend along the entire internal wall or in other words the chamber 230 is internally corrugated.

The ribs 2301 provide retention of the aerosol-generating article 10 when positioned in the chamber 230 together with ensuring airflow. Two subsequent or neighbouring retention ribs 2301 form a passage there between where air can flow during a user's puff.

The ribs 2301 are arranged on the internal sidewall of the receiving chamber 230 along helicoidal lines 2302. This feature provides a particularly advantageous effect as it enhances the retention properties of the chamber: once the aerosol-forming article 10 has been inserted, the curved retention ribs offer an additional resistance upon removal of the article 10 if compared to, for example, straight ribs.

The helicoidal lines 2302 are turning around the longitudinal axis 2300 of the receiving chamber 230 with a pitch of 150 mm. Thus, in this embodiment a rib performs only a small portion of an entire turn in the receiving chamber. In FIG. 4, the length of the distal portion 231 of the cavity or of the receiving chamber is about 17 mm to about 18 mm, the length of the proximal portion is about 6.5 mm to about 7.5 mm and the length of the inlet portion 233 is about 1.8 mm to about 2.3 mm. A length of the receiving chamber is about 26 mm to 30 mm and an outer diameter of the receiving chamber is about 10 mm to 12 mm.

Applying an equal—high—retention pressure on the aerosol-generating article 10 along the entire receiving chamber 230 might cause a risk of breakage of the article 10, particularly in the zone of the aerosol-forming substrate 20.

Accordingly, retention ribs 2301 have a variable height along their development on the internal sidewall, in order to adjust the retention pressure applied with regard to the different portions of the aerosol-forming article 10.

Ribs 2301 have a first height in correspondence to the distal portion 231 of the chamber which retains the aerosol-forming substrate 20. Ribs 2301 have a second height in correspondence to the proximal portion 231 which applies a retaining pressure to the support element 30. Advantageously, the second height is larger than the first height. As a consequence, the retaining action is larger in correspondence to the support element 30, which is made of resistant material and does not change its physical properties during smoking, and lower in correspondence to the distal portion 231 where the retention ribs encompass the aerosol-forming substrate 20. Advantageously, the first height of the ribs is adapted such as to limit the retention (which may cause breakage during removal of the article 10) and at the same time still ensuring the presence of passages to guarantee airflow during puffs.

The retention ribs may have a third height in correspondence to the inlet portion 233 of the chamber 230, which third height is preferably lower than the second height. In particular, the third height might be the same as the first height. The diminished height of the ribs in the inlet portion 233 with respect to the height of the ribs of the adjacent proximal portion 232 facilitates the insertion of the article 10 inside the receiving chamber 230.

It will be understood that the maximum retaining action is provided by the portion of the inward ribs 2301 located in the proximate portion 232 of the receiving chamber 230, which act on the support element 30. The high retention action in the proximal portion is adapted to still ensure an airflow passage along the ribs.

In the distal and inlet portions 231, 233 the retention ribs are configured to offer a lesser retention whilst still ensuring the presence of airflow passages.

Figure 5:
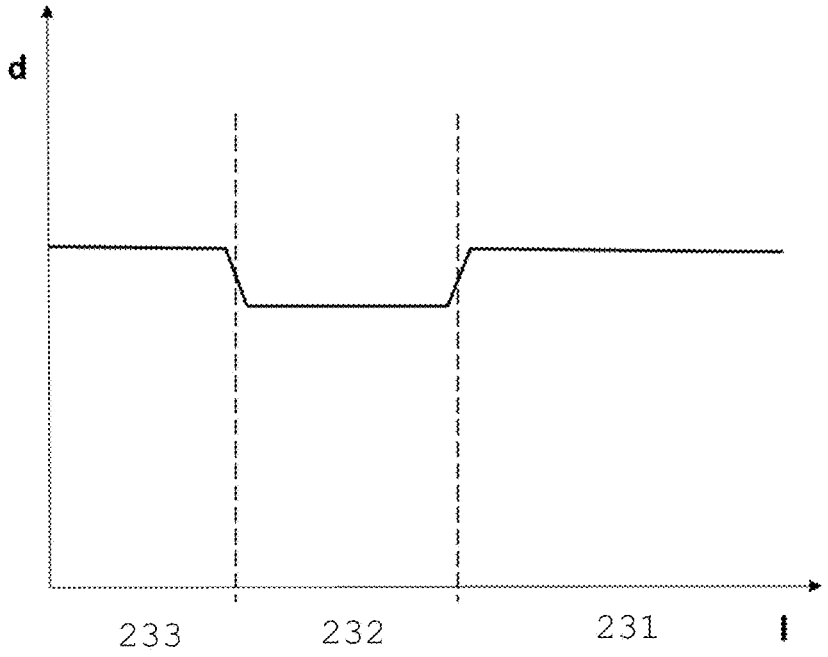
FIG. 5 schematically illustrated an internal diameter distribution of a receiving chamber.

The larger the height of the inwardly extending ribs 2301, the smaller the receiving radial section of the chamber 230 gets. This is illustrated in FIG. 5 by means of an example of the variance of an effective inner diameter d of the radial section of the chamber 230 along its axial development 1. Between adjacent portions 233,232,231 which transition portions are indicated by dashed lines, a value of the height of ribs 2301 may transition linearly. In FIG. 5 inner diameter in the distal and in the inlet portion are about the same.

Exemplary values, in particular for embodiments having different inner diameters d in inlet and distal portion may be:

Exemplary values of effective inner diameters d of the proximal portion 232 are between about 6.7 mm and 7.1 mm.

Exemplary values of effective inner diameters d of the distal portion 231 are between about 7.3 mm and 7.7 mm.

Exemplary values of effective inner diameters d of the inlet portion 233 are between about 8.0 mm and 8.4 mm.

The invention claimed is:

1. An aerosol-generating device comprising a device housing comprising a cavity having an internal surface forming part of a receiving chamber for receiving at least a portion of an aerosol-generating article, further comprising a plurality of retention ribs extending into the cavity and being arranged along an internal sidewall of the receiving chamber in an oblique manner relative to a longitudinal axis of the receiving chamber, the retention ribs being configured for contacting and retaining at least a portion of the aerosol-generating article when the article is accommodated in the receiving chamber, and wherein the retention ribs of the plurality of retention ribs are arranged along helicoidal lines and are distanced from each other, thereby defining airflow passages in between neighbouring retention ribs.

2. The aerosol-generating device according to claim 1, wherein the airflow passages are dimensioned such that during use of the device, a resistance to draw (RTD) of between 70 mmWG and 120 mmWG is achieved.

3. The aerosol-generating device according to claim 1, wherein a circumference of the internal surface of the cavity is of cylindrical shape.

4. The aerosol-generating device according to claim 1, wherein at least one retention rib of the plurality of retention ribs has a variable height along its development on the internal sidewall of the receiving chamber.

5. The aerosol-generating device according to claim 1, wherein the internal sidewall comprises a distal portion, a proximal portion adjacent to the distal portion and an inlet portion adjacent to the proximal portion, the inlet portion further being arranged at a proximal end of the aerosol-generating device, and wherein the plurality of retention ribs is arranged in the distal portion, in the proximal portion and in the inlet portion of the internal sidewall of the receiving chamber.

6. The aerosol-generating device according to claim 5, wherein each of the retention ribs has a first height in the distal portion of the internal sidewall and a second height in the proximal portion of the internal sidewall, wherein the second height is larger than the first height.

7. The aerosol-generating device according to claim 6, wherein each of the retention ribs has a third height in the inlet portion, wherein the second height is larger than the third height.

8. The aerosol-generating device according to claim 7, wherein the third height is equal to the first height.

9. The aerosol-generating device according to claim 1, wherein each of the retention ribs is continuous.

10. An aerosol-generating system comprising the aerosol-generating device according to claim 1 and the aerosol-generating article comprising an aerosol-forming substrate, wherein when the aerosol-generating article is accommodated in the receiving chamber of the aerosol-generating device, the retention ribs of the plurality of retention ribs distance an outer circumference of the aerosol-generating article from the internal sidewall of the receiving chamber and the airflow passages are defined between neighbouring retention ribs of the plurality of retention ribs.

11. A receiving chamber of an aerosol-generating device for receiving at least a portion of an aerosol-generating article, the receiving chamber comprising a chamber wall enclosing a cavity with a plurality of retention ribs extending into the cavity, the retention ribs being arranged along an internal sidewall of the receiving chamber and in an oblique manner relative to a longitudinal axis of the receiving chamber, the retention ribs being configured for contacting and retaining at least a portion of the aerosol-generating article when the article is accommodated in the receiving chamber, wherein the retention ribs of the plurality of retention ribs are arranged along helicoidal lines and are distanced from each other, thereby defining airflow passages in between neighbouring retention ribs.

12. The receiving chamber according to claim 11, wherein each retention rib has a variable height along its development on the internal sidewall.

13. The receiving chamber according to claim 11, wherein the internal sidewall comprises a distal portion, a proximal portion adjacent to the distal portion and an inlet portion adjacent to the proximal portion, the inlet portion further being arranged at a proximal end of the receiving chamber, and wherein each of the retention ribs has a first height in the distal portion and a second height in the proximal portion, wherein the second height is larger than the first height.

* * * * *